United States Patent [19]

Oden

[11] Patent Number: 4,509,658

[45] Date of Patent: Apr. 9, 1985

[54] ANTI-THEFT DEVICE FOR TANDEM COLUMN VENDOR

[75] Inventor: Kenneth W. Oden, Charles Town, W. Va.

[73] Assignee: Dixie-Narco, Inc., Ranson, W. Va.

[21] Appl. No.: 569,910

[22] Filed: Jan. 11, 1984

[51] Int. Cl.[3] ..... B59Q 59/00

[52] U.S. Cl. ..... 221/115; 221/116; 221/266

[58] Field of Search ..... 221/67, 93–94, 221/112, 114–118, 193–196, 295–296, 241, 266

[56] References Cited

U.S. PATENT DOCUMENTS

| | | | |
|---|---|---|---|
| 2,981,441 | 4/1961 | Watlington | 221/67 |
| 3,107,030 | 10/1963 | Taylor | 221/116 |
| 3,125,246 | 3/1964 | Barnhart | 221/116 |
| 3,146,907 | 9/1964 | Bookout | 221/67 |
| 3,158,289 | 11/1964 | Van Brunt | 221/116 |
| 3,209,942 | 10/1965 | Gasparini et al. | 221/67 |
| 3,263,856 | 8/1966 | Gasparini | 221/67 |
| 3,341,069 | 9/1967 | Newbury | 221/116 |
| 3,349,961 | 10/1967 | Nathan et al. | 221/301 X |
| 3,424,345 | 1/1969 | Payne | 221/116 |
| 3,799,393 | 3/1974 | Baxendale | 221/67 |
| 4,036,400 | 7/1977 | Oden | 221/67 |
| 4,298,138 | 11/1981 | Oden | 221/115 |
| 4,460,107 | 7/1984 | Lindsey | 221/115 X |

*Primary Examiner*—Charles A. Marmor

*Attorney, Agent, or Firm*—Cushman, Darby & Cushman

[57] ABSTRACT

A vendor for sequentially vending in alternation successive lowermost articles, such as beverage cans, from at least two stacks which are arranged in tandem, using a shared generally semi-cylindrical angularly indexable cradle having a stepped edge, where angular movement of the cradle by a first increment is sufficient to drop one supported article from under a forward one of the stacks to a delivery station, but insufficient to drop an axially adjacent supported article from under a relatively rearward one of the stacks, is improved by being provided with an anti-theft device preferably in the form of a leaf spring based on the cradle and erectable into the volume of space which is at other times occupied by the one supported article. The leaf spring is so constructed and mounted that when respective articles are supported in both forward and rear spaces in the cradle, the article supported in the relatively forward space flattens the spring to an inactive disposition, but when that article is dropped from the cradle by angularly moving the cradle through a first increment, the spring erects so as to prevent the article supported in the relatively rearward space from being slid or pulled axially forwards to the relatively forward space from which it would drop.

17 Claims, 11 Drawing Figures

ANTI-THEFT DEVICE FOR TANDEM COLUMN VENDOR

BACKGROUND OF THE INVENTION

There is described in my earlier U.S. Pat. No. 4,298,138 a tandem column vendor apparatus in which a rotary cradle extends from front to back of a compartment for holding columns of articles to be dispensed. The cradle is of generally semicylindrical hollow shape having a straight axial leading edge and a stepped trailing edge and mounted to be rotated about its cylinder axis. The cradle is free of internal partitions and is adapted for sequentially dispensing front and then rear articles from front and rear columns of articles in the compartment, or for dispensing single longer articles. A removable support in the cradle holds long narrow articles at the proper height for supporting a column of those articles in the compartment at the proper elevation for the straight leading edge of the cradle to isolate and support the column while dispensing an article in the cradle.

The tandem column vendor apparatus of my aforementioned earlier patent employs a single semicylindrical cradle mounted for rotation below either a single column or front and rear columns of different articles to be dispensed. The cradle is free of partitions, so that it can receive either a pair of shorter cylindrical articles, such as cans of beverage or a single longer article such as a bottle of beverage. When adapted to dispense articles from front and rear columns, the cradle is rotated through a part revolution at which time the leading edge at the front of the cradle becomes spaced from a sidewall a distance at least equal to the diameter of its article, and that article may drop to a dispensing station. Upon the next actuation, the cradle is rotated further to bring the corresponding edge of the rear part of the cradle to a sufficiently spaced relation from the compartment sidewall to let the rear article drop to the delivery station. The leading edge of the cradle enters between those articles in the cradle and the columns thereabove to support the articles in the columns above the cradle during the dispensing cycles.

An attachment is provided to be placed in the cradle to hold articles of smaller diameter, but greater length, such as bottles, at a proper height to support the column thereabove at such elevation that the leading edge of the cradle will enter between the article in the cradle and the articles thereabove to support the latter without having to unduly lift the weight of the column during rotation of the cradle. When employed to dispense bottles, as will be described, the motor or driving mechanism is so adapted that it rotates the cradle one complete revolution from each cycle of operation, whereas when dispensing cans sequentially from front and rear columns, the motor operates through only a partial rotation of the cradle after dispensing the front article and before delivering the article from the rear column.

It may be noted that as the cradle of this earlier patent rotates, it reaches a point (illustrated in FIG. 6 of that patent), where the foremost of the two cradled articles (e.g. beverage cans) will be dispensed, but the rearmost of the two will remain cradled.

While the vendor disclosed and claimed in my aforementioned earlier patent has proved to be commercially acceptable, I have learned that the vendor structure as disclosed in that patent has a shortcoming, and so I have devised a way of improving that vendor, and ones like it, by providing a relatively simple means for overcoming the shortcoming.

In particular, when the cradle of the vendor shown in my aforementioned U.S. patent is in its FIG. 6 disposition, and the contained foremost article has been vended from the cradle, it is possible for a vandal to victimize the vendor's owner by tilting the vendor forwardly or rocking it back and forth, or by reaching it through the delivery station of the vendor, hooking onto the rearmost cradled article with a bent coathanger or similar tool, and in any one or a combination of these ways, causing the rearmost cradled article to slide forwards in the cradle to the former site of the most recently dispensed formerly foremost cradled article. At this point, the slid-forwards article will drop from the cradle to the delivery station and be stolen.

SUMMARY OF THE INVENTION

A vendor for sequentially vending in alternation successive lowermost articles, such as beverage cans, from at least two stacks which are arranged in tandem, using a shared generally semi-cylindrical angularly indexable cradle having a stepped edge, where angular movement of the cradle by a first increment is sufficient to drop one supported article from under a forward one of the stacks to a delivery station, but insufficient to drop an axially adjacent supported article from under a relatively rearward one of the stacks, is improved by being provided with an anti-theft device preferably in the form of a leaf spring based on the cradle and erectable into the volume of space which is at other times occupied by the one supported article. The leaf spring is so constructed and mounted that when respective articles are supported in both forward and rear spaces in the cradle, the article supported in the relatively forward space flattens the spring to an inactive disposition, but when that article is dropped from the cradle by angularly moving the cradle through a first increment, the spring erects so as to prevent the article supported in the relatively rearward space from being slid or pulled axially forwards to the relatively forward space from which it would drop.

The principles of the invention will be further discussed with reference to the drawings wherein a preferred embodiment is shown. The specifics illustrated in the drawings are intended to exemplify, rather than limit, aspects of the invention as defined in the claims.

DETAILED DESCRIPTION OF A PRESENTLY PREFERRED EMBODIMENT

Figure 1:
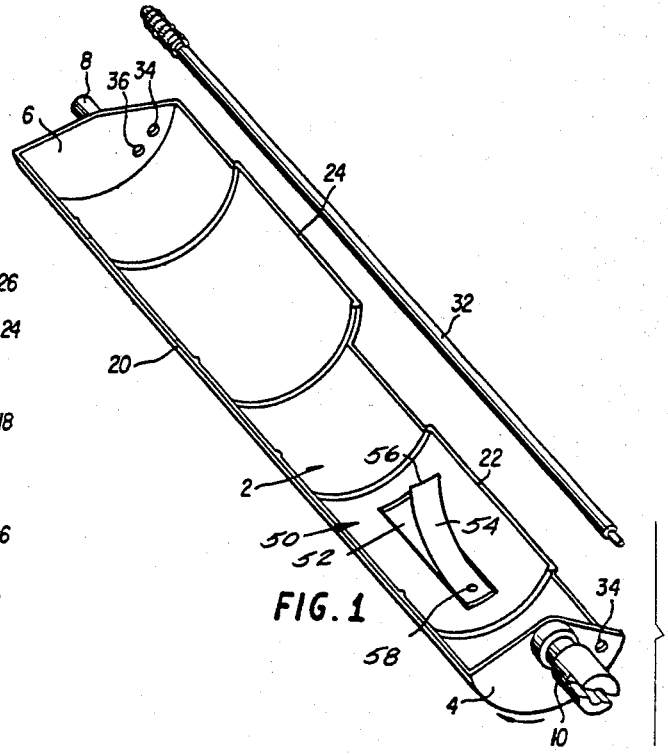
FIG. 1 is a perspective view of the cradle of the preferred embodiment disclosed in my aforementioned earlier U.S. Pat. No. 4,298,138, improved by being provided with an anti-theft device in accordance with principles of the present invention.

In FIG. 1, numeral 2 designates a rotary cradle provided with the anti-theft device 50 of the present invention.

For convenience in description the features of construction and operation of the presently preferred embodiment which it shares with the apparatus of my aforementioned earlier U.S. Pat. No. 4,298,138 will first be reiterated, then the construction and operation of the anti-theft device 50 will be described in detail and related to the description of the basic apparatus.

Figure 2:
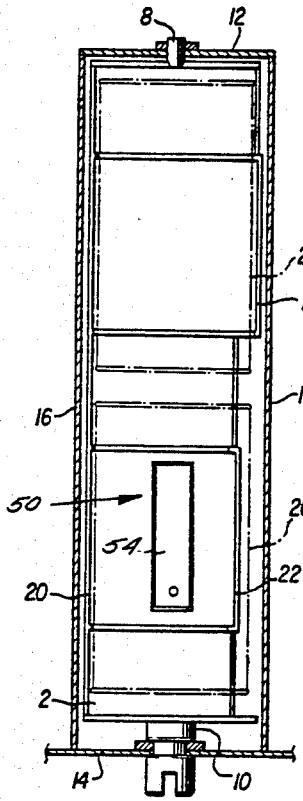
FIG. 2 is a top plan view of the cradle of FIG. 1 showing the same mounted in a compartment of a vending machine, as seen from the line 2—2 of FIG. 5.

It is to be noted that when mounted in a vending machine, the cradle will be rotated in a clockwise direction as viewed from the near end, in the direction indicated by the arrow. For supporting the cradle in the vending machine, it is provided with end walls 4 and 6 and stub shafts 8 and 10 by which it is rotatably mounted in end walls 12 and 14, respectively, in a compartment (FIG. 2) of a suitable vending machine cabinet. The compartment is further defined by sidewalls 16 and 18. The forward end of the stub shaft 10 is configured to be engaged by a suitable driving mechanism (not shown) which will be referred to later.

It is to be noted that the leading edge of the cradle 2 defines a straight edge 20, whereas its trailing edge is stepped to define a front step 22 and a rear step 24. The steps 22 and 24 being of different circumferential extent for a purpose to be described. It is to be noted that the cradle 2 is not provided with any fixed internal partitions or separating means, but is of sufficient length to receive a pair of cans 26 from columns of the cams in the compartment and extending above the cradle. The region of the compartment below the cradle leads to or may itself be a delivery station for delivery of the articles to a purchaser.

Referring now to FIGS. 5–8, FIG. 5 shows schematically how the apparatus appears from the front between cycles of operation. As seen, the cradle 2 is stopped with its open side uppermost, and with the step 24 being substantially at the same level as the straight leading edge 20 of the cradle. When the mechanism is actuated to dispense a single can from the apparatus, the cradle is first rotated to substantially the position shown in FIG. 6, wherein its step 22 is sufficiently spaced from compartment wall 18 to permit the can in the front part of the cradle to drop, as indicated, to the dispensing or delivery station. At the same time, a straight leading edge 20 of the cradle has moved between the cans in the cradle, and those in the column thereabove to support the latter while dispensing takes place. When the parts reach the position shown in FIG. 6, the motor is stopped and the apparatus is thus quiescent until the next cycle of operation is initiated. In this position, it is to be noted that the step 24 is still sufficiently close to the compartment wall 18 to prevent the rear can 26′ from dropping therefrom and that rear can is held in the cradle until the next cycle of operation is initiated.

Figure 7:
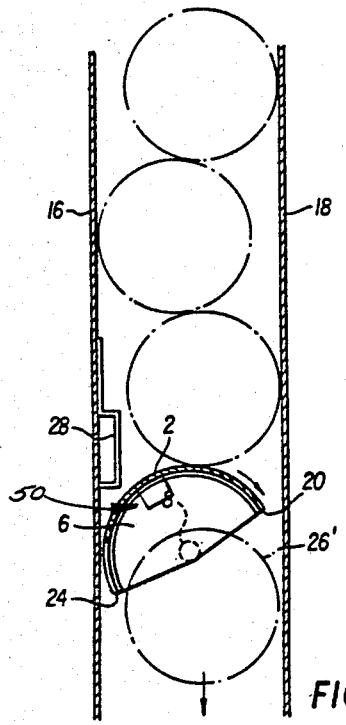

The next cycle of operation is indicated in FIG. 7 wherein the cradle 2 has been further rotated in a clockwise direction, sufficiently far, so that the step 24 now permits the rear can 26′ to drop to the delivery station, and during this time the cylindrical wall of the cradle 2 has held both columns of articles above the cradle in their upper position, and prevents their dropping to the delivery station.

Figure 8:
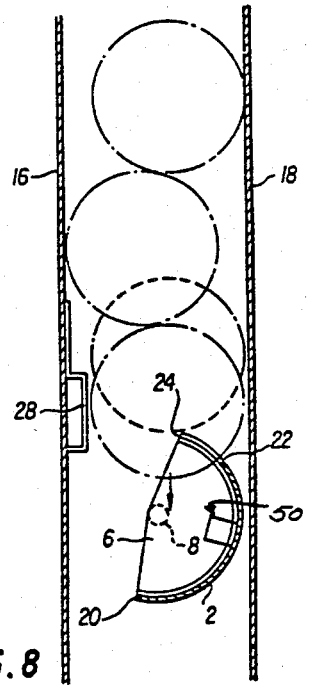

After the parts pass the position shown in FIG. 7, rotation is continued until they reach the position shown in FIG. 8, at which time the front step 22 has passed the center line of the column of articles in the column thereabove, and the front can has dropped slightly while the step 24 still holds the rear column in its elevated position. Continued rotation in a clockwise direction from the position of FIG. 8 will first permit the step 22 to move downwardly and to the right far enough to permit the front can to drop into the cradle and thereafter the rear can also drop into the cradle to re-establish the conditions shown in FIG. 5 at which time the rotation of the cradle is stopped pending the next cycle of operation.

Figure 5:
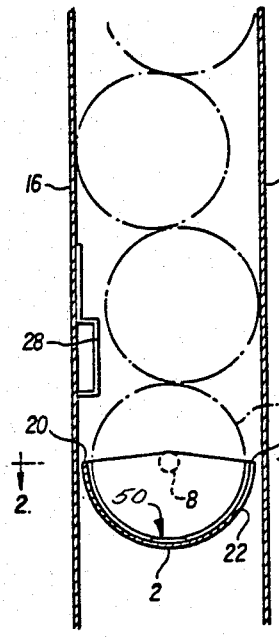
FIGS. 5, 6, 7 and 8 are sequential views schematically showing the steps in dispensing front and rear articles from front and rear columns.

Removably mounted on the sidewall 16 of the compartment guiding the columns of articles is a shim or projection member 28. If reference is made to FIG. 6 or FIG. 7, it will be seen that the cans in the column above the cradle are capable of considerable lateral movement and the bottom can of that column could come to rest on the can in the cradle in a position adjacent the sidewall 16 of the compartment. In that case, the leading edge 20 of the cradle when operating in its first cycle of operation, would impinge on a side portion of the lowermost can in the column above the cradle, and this would necessitate exerting considerable force to lift the entire column to permit the cradle wall to pass thereunder to the position shown in FIG. 6 for supporting the same. The projection 28 forces the lowermost can in the column above the cradle to take a position to the right as seen in FIG. 5, thus minimizing any lifting effort that must be exerted by the leading edge of the cradle in passing between those articles in the cradle and those thereabove.

When the cradle rotates to let a new set of cans drop into it, as described, the steps which let the cans down are the same steps that vend the cans and therefore not a straight edge, but stepped in the manner described. Since no fixed dividers or partitions are employed, cans can be loaded rapidly, but one set may be all the way back in the compartment and some all the way forward. As the front column lets down ahead of the back column, these overlaps could cause the cans in the front column to cock severely if they drop down a full diameter before the rear column drops. The projection 28 already described also solves this problem. The projection is in the front column area only. This pushes the front cans over to the right and closes down the columns which make the cradle rotate further before the front can drops in, instead of the front row dropping the full can diameter before the back row drops. Thus, there is less than a half can diameter of overlap (see FIG. 8) and any cocking that occurs levels up when the back row drops.

Figure 9:
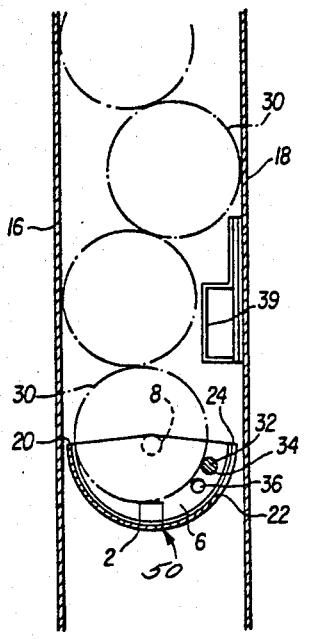
FIGS. 9, 10 and 11 are views similar to FIGS. 6–8, but showing the apparatus when dispensing single articles, such as bottles, from a single column in the compartment of the apparatus.
Figure 10:
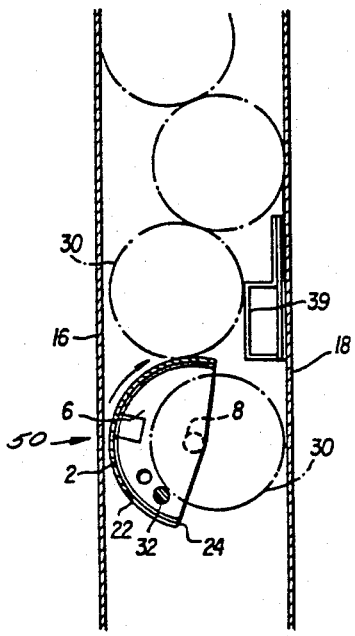
Figure 11:
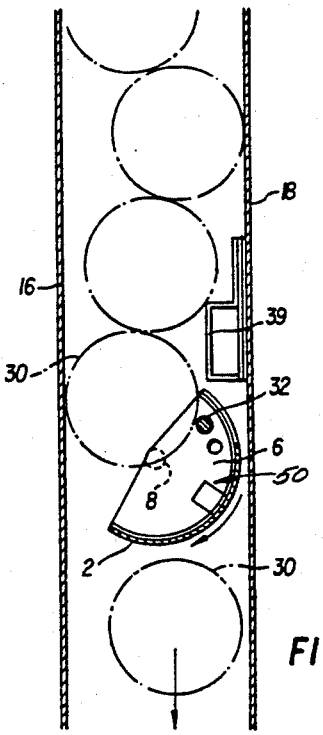

Referring now to FIGS. 9–11, as shown in these figures, the cans 26 in front and rear columns have been replaced by bottles 30 in a single column above the cradle 2. The bottles 30 are longer than the cans 26 and thus only a single bottle can be received in the cradle at a time. To adapt the apparatus for dispensing of such bottles, which are conventionally of smaller diameter than cans, a support rod 32 is mounted in the cradle in the position generally shown in FIG. 9 to hold the bottle 30 in an elevated position, rather than letting it rest on the bottom of the interior of the cradle 2. The rod or support 32 is positioned so that the upper side of the bottle therein lies substantially at the imaginary outer periphery of the cylinder defined by the cradle, and thus the straight leading edge 20 of the cradle can readily and easily enter between the bottle 30 in the cradle and the column of bottles thereabove to support the same without having to unduly lift the weight of the column during rotation. A projection 39 is mounted on the right hand wall 18 of the compartment and this forces the bottom bottle of the column above the cradle to the left, so that it rests on the bottle in the cradle substantially directly above the same and in position to be easily separated by projecting the edge 20 between the bottles.

FIG. 9 shows the apparatus with the parts in position between dispensing cycles.

FIG. 10 shows the apparatus when operated through a partial cycle and wherein the support 32 is still in position to retain the bottle 30 between that support and the sidewall 18, the column of bottles above the cradle now being supported by the cradle. Continued rotation of the cradle in the clockwise direction will move the support 32 sufficiently far from the wall 18 to permit the bottle 30 therein to drop to the delivery station while the periphery of the bottom part of the cradle still supports the column of bottles thereabove. As the cradle continues to rotate to the position of FIG. 11, the support 32 moves far enough away from the wall 16 to permit the bottom bottle 30 of the column of bottles to drop into the cradle, and the latter is then stopped when it reaches the position shown in FIG. 9. It is to be noted that each cycle of operation, when dispensing bottles, comprises a complete revolution of the cradle.

Figure 6:
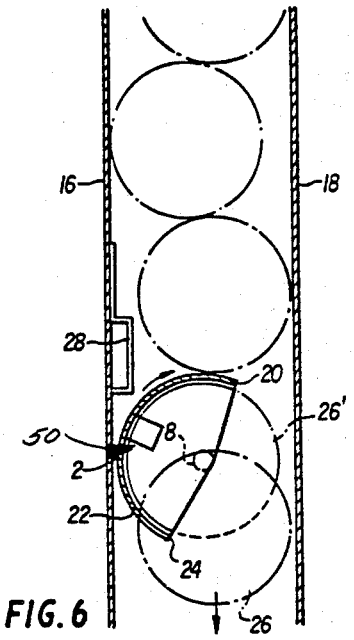

While no means have been shown for stopping the cradle in its front column dispensing position shown in FIG. 6, it is to be understood that the mechanism for doing so is old and well known in the art. Dispensing machines of this type have been constructed wherein a drive motor operates under control of a cam having adjustable features whereby it can be stopped at any point in its rotation or permitted to complete a full turn before being stopped.

Figure 3:
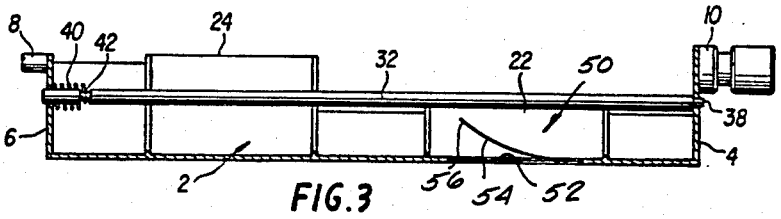
FIG. 3 is a vertical sectional view through a portion of the cradle of FIG. 1 with the adapter attachment mounted therein.
Figure 4:
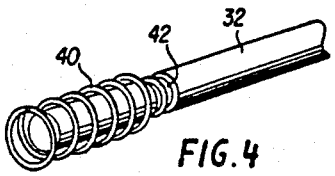
FIG. 4 is a fragmentary perspective view of an end of the adapter attachment.

Referring now to FIGS. 3 and 4, the support or rod 32 is shown in greater detail and it is to be noted that the end walls 6 and 4 of the cradle are provided with openings 34 and 36 therein, the openings 34 being axially aligned, as are the openings 36.

A support rod 32 is of reduced diameter at one end 38, and projects into an opening 34 or 36 of smaller diameter than the rod 32. Thus, a shoulder on the rod limits axial movements of the rod toward that end wall. The other end of the rod 32 is surrounded by a compression spring 40 anchored in a recess or channel 42 in the rod, and which normally projects slightly beyond the end of the rod 32. The openings 34 and 36 in the end wall 6 are sufficiently large to receive the end of the rod 32 and the spring 40 may be axially compressed sufficiently to permit the reduced end 38 of the rod to slide downwardly within the end wall 4 and thereafter to be projected outwardly through an opening 34 in that end wall. Openings 34 and 36 are provided whereby the cradle may be adapted to dispense bottles or articles of somewhat different diameters.

In accordance with principles of the present invention, the cradle 2 is provided with an anti-theft device 50, the preferred embodiment of which is depicted in FIGS. 1–3 and 5–11 of the drawings.

As shown, the bottom of the interior of the cradle 2 is provided in its front part, angularly approximately halfway between its leading edge 20 and its rear step 24, with a shallow pocket 52 which opens toward the interior of the cradle. This pocket 52 is sized and placed for juxtaposition with the sidewall of a front can when a front can is contained in the front part of the cradle 50. A flat spring 54 is mounted towards its own forward end, to the cylindrically curved floor of the cradle, within the pocket 52. The flat spring 54 is formed of resilient material and with a slight upward curl to it, so that whereas it may be pushed down flat so that it is juxtaposed with the floor of the cradle along all of its own length, if nothing is pressing down on it, its free end 56 lies spaced substantially above the floor and aimed towards the rear of the cradle. By preference, the pocket 52 is as deep as the spring 54 is thick and has a perimeter which closely outlines the spring 54. However, in some instances, the pocket 52 may not be needed, and the spring 54 simply pinned, e.g. by the rivet 58, to the corresponding site on the cradle floor to be pushed flat against the floor rather than recessed into a pocket.

To state some present preferences for exemplary purposes, the flat spring 54 may be made of 18-8 stainless steel sheet, 0.010 inch thick by one-half inch wide and 2.5 inches long. When this exemplary spring is free, as shown in FIG. 1, it curves upwards from its pinned connection 58 to the cradle floor to the extent that its rear, free end 56 lies approximately one-half inch above the cradle floor surface. The amount of weight necessary to resiliently flatten this exemplary spring to the flat condition shown in FIG. 5 is approximately five ounches, i.e. considerably less than the weight of the individual articles such as cans or bottles of beverage to be dispensed from the vendor.

Accordingly, when the vendor is being used as a tandem column can vendor, at times when there are cans contained in both the front and rear sites within the cradle (e.g. the condition depicted in FIG. 5), the weight of the contained front can 26 holds the spring 54 flat on the floor of the cradle. However, when the cradle angularly indexes to the position shown in FIG. 6 and the front can is dropped from the front site over the trailing edge portion 22, the spring 54 recovers its built-in bend or curl, so that its rearwardly-pointing free end is disposed far enough off the floor of the cradle to represent a barrier to the rear can 26' contained in the cradle. Thus, no amount of rocking or tilting of the vendor or of probing up through the delivery station when the cradle is in its FIG. 6 angular disposition, will permit the contained rear can 26' to be slid or pulled forwardly sufficiently to clear the relatively extended trailing rear edge portion of the cradle. Rather, the rear can is maintained in an impounded condition by the cradle, until insertion of the proper coins or other credit, and the making of a respective selection causes the cradle 2 to be angularly indexed from its FIG. 6 disposition to its FIG. 7 disposition, permitting the rear can to drop from the cradle over the rear trailing edge portion 24.

In other respects the operation of the vendor, including the cradle 2 may be as described above, with no substantial difference or any impediment being embodiment in providing and using the anti-theft device of the present invention.

Although the anti-theft device 50 of the present invention was particularly developed for use with a vendor constructed and operated as described in my aforementioned earlier U.S. Pat. No. 4,298,138, it should be apparent that without any substantial conceptual modification, it may be employed on other tandem column vendors which have angularly movable, stepped-edge cradles without fixed partitions or separating means between the respective can-cradling sites within the open side of the cradle, even where the cradle is designed to be reversely angularly indexed rather than always angularly indexed in a same, e.g. clockwise direction, and even where other means than simply the curved underside of the cradle (for instance a collapsible shelf means disposed above the cradle), are used for supporting one or more of the columns of articles in any segment of the dispensing cycle.

The terms "forward" and "rear", and "clockwise" are used herein for convenience in description; it should be apparent that without departing from the principles of the invention, the apparatus shown may be oriented end-for-end or half-way around in either angular direction relative to the "front" of the vendor without departing at all from the principles of the invention. The orientation shown is simply the one that is presently preferred.

It should now be apparent that the anti-theft device for tandem column vendor as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. In a vending machine:

means defining a compartment adapted to hold front and rear columns of cylindrical articles of predetermined diameter;

a dispensing cradle in the lower end portion of said compartment and comprising a hollow, open-sided, generally semi-cylindrical cradle extending from front to rear of said compartment and mounted for angular movement about its own longitudinal axis, said axis extending from front to rear of said compartment;

said cradle internally having wall means defining a floor provided with a front site constructed and arranged to receive through the open side of the cradle and to support a front cylindrical article from a front column of cylindrical articles when such a column is held in said compartment, and with a rear site constructed and arranged to receive through the open side of the cradle and to support a rear cylindrical article from a rear column of cylindrical articles when such a column is held in said compartment the front site axially adjoining the rear site within the cradle;

said cradle wall means providing an axially extending leading edge which, axially coincident with said front site and said rear site is effectively at a common angular disposition;

said cradle wall means providing a stepped axially extending trailing edge which, axially coincident with said front site and said rear site is effectively at two substantially different angular dispositions, so that angular rotation of said cradle by a first increment about said axis is sufficient to permit a said cylindrical article if contained in said cradle at said front site to drop therefrom over said trailing edge, but insufficient to permit a said cylindrical article if contained in said cradle at said rear site to drop therefrom until said cradle has been angularly rotated by a second increment about said axis;

said cradle being characterized by being internally free of fixed transverse partitioning between said front site and said rear site, whereby said compartment may selectively contain, and said cradle may hold, a single column of alternate articles which are so much longer than said cylindrical articles that in order to be contained in said cradle, one of them would need to occupy at least parts of both said front site and said rear site;

an anti-theft device comprising:

a raiseable/lowerable barrier disposed within said cradle for preventing when raised a said cylindrical article if contained in said cradle at said rear site at a time when said front site is empty of any said cylindrical article, from being urged axially forwards sufficiently from said rear site towards said front site when said cradle has angularly rotated about said axis only by said first increment as to be able to fall over said trailing edge; and means associated with said barrier and said cradle for effectively raising said barrier when said front site is empty of a said cylindrical article and for permitting said barrier to be effectively lowered out of the way when said front site either contains a said cylindrical article or when at least part of said rear site and at least part of said front site in common contain a said alternate article.

2. The vending machine of claim 1, wherein:

said barrier comprises an elongated flat spring made of resilient material; and said associated means comprises a fastener securing the flat spring near one end thereof to said wall means of said cradle, and said flat spring being constructed and arranged to angle upwardly and rearwardly from where it is secured by said fastener to said wall means when not pressed down towards said floor by having weighing down thereon either a said cylindrical article contained in said cradle at said front site or a said alternate article contained in said cradle at least partly in said front site;

said flat spring having a stop means formed thereon distally of said one end and being constructed and arranged to face rearwardly at such an elevated level when said barrier is raised, as to be positioned to abut the forward end of a said cylindrical article when contained in said rear site upon any attempt being made to urge such cylindrical article substantially forwards from said rear site when no said article is contained in said front site.

3. The vending machine of claim 2, wherein:

said flat spring, except when resiliently pressed down by a said article weighing thereon, curls upwards from where it is secured by said fastener to said wall means; and said stop means is provided by a rear end of said flat spring.

4. The vending machine of claim 3, wherein:

said wall means defining said floor includes means defining a shallow pocket constructed and arranged to receive said flat spring when said flat spring is pressed down by a said article weighing thereon.

5. The vending machine of claim 1, wherein:

said anti-theft device is provided by an elongated leaf spring secured near a forward end therof to the cradle by a securement means and being constructed and arranged to angle upwardly and rearwardly from such securement, when not resiliently pressed down by a said article weighing thereon.

6. The vending machine of claim 5, wherein:

said securement means is constituted by a rivet.

7. The vending machine of claim 5, wherein:

the internal diameter of said cradle is substantially equal to the diameter of said cylindrical articles whereby rotation of said cradle with cylindrical articles therein and columns of said articles thereabove will cause said leading edge to move between the articles in said cradle and those thereabove, without substantially lifting said column to support the latter while sequentially dispensing those in the cradle.

8. A vending machine as defined in claim 1 including:

means for removably mounting a support member in said cradle in position to support said alternate articles, of less diameter than said cylindrical articles, with their upper surfaces radially outwardly of said cradle at least to the cylinder defining the outer surface of said cradle.

9. A vending machine as defined in claim 8, wherein:

said cradle is provided with transverse walls at its axial ends, said means for mounting said support member comprising axially aligned openings in said end walls.

10. A vending machine as defined in claim 9, wherein:

said support member is an elongated rod arranged with its ends in said openings.

11. A vending machine as defined in claim 10, wherein:

one of said openings is of smaller diameter than the other, the end of said rod in said one opening being of reduced diameter and defining a shoulder on said rod abutting the end wall having said one opening, and resilient means urging said shoulder toward said one opening.

12. A vending machine as defined in claim 1, wherein:

said compartment is of a width greater than the diameter of the articles of a column of articles therein, and removable means on at least one sidewall of said compartment arranged to position at least the bottom article of a column above said cradle in predetermined position at one side of said compartment.

13. For use in a vending machine designed to alternatively, sequentially alternately vend successive lowermost cylindrical articles from two columns of such cylindrical articles arranged in tandem, and sequentially vend successive lowermost alternate articles, which are substantially longer than individual ones of said cylindrical articles, from a single column of such alternate articles arranged in place of said two columns, a dispensing cradle constructed and arranged to be disposed under all of said columns, said dispensing cradle comprising:

peripheral sidewall means and opposite end wall means providing a hollow, one open-sided generally cylindrical cradle;

said end wall means including means for mounting the cradle for angular movement about its own longitudinal axis;

said peripheral sidewall means defining internally of said cradle a floor provided with two axially adjoining sites including a first site constructed and arranged to receive through said one open side of the cradle and to support, a said cylindrical article from one said two columns, and a second site constructed and arranged to receive through said one open side of the cradle and to support a said cylindrical article from the other of said two columns;

said cradle being characterized by being internally free of fixed transverse partitioning between said first site and said second site, whereby said compartment cradle may alternately receive through said one open side of the cradle and support at one time only a single said alternate article, with such single said alternate article occupying at least part of said first site and at least part of said second site;

said cradle-providing peripheral sidewall means further including two axially extending edges at respective angularly opposite extremes thereof, these two edges providing said one open side of said cradle to be sufficiently wide as to receive two of said cylindrical articles therethrough from above, when arranged in tandem and at least generally aligned therewith, and as to alternatively receive one of said alternate articles therethrough from above, when generally aligned therewith;

said cradle sidewall edges being constructed and arranged to permit two said cylindrical articles if received in said cradle respectively at said first and second sites, to be independently sequentially dispensed therefrom over at least one of said cradle sidewall edges respectively upon angular movement of the cradle a first angular increment and a second angular increment about said axis, and to permit one of said alternate articles if received in said cradle respectively at least partially at said first site and at least partially at said second site, to be dispensed therefrom over at least one of said cradle sidewall edges upon angular movement of the cradle a selected angular increment about said axis;

an anti-theft device, comprising:

an erectable/stowable barrier mounted to said cradle;

said barrier being constructed and arranged when erect for preventing a said cylindrical article if contained in said cradle at said second site at a time when said front site is empty of any said cylindrical article, from being urged axially sufficiently from said second site towards said first site when said cradle after having rotated about said axis by said first angular increment has not yet angularly rotated about said axis by said second angular increment; and said barrier being further constructed and arranged to become automatically stowed upon reception through said one open side of said cradle of a said cylindrical article into said cradle at said first site, to become automatically stowed upon reception of a said alternate article into said cradle, and to become and remain automatically erected when said first site is emptied of either a said cylindrical article or a said alternate article out through said one open side of said cradle.

14. The vending machine of claim 13, wherein:

said barrier comprises an elongated flat spring made of resilient material; and a fastener securing the flat spring near one end thereof to said wall means of said cradle;

said flat spring being constructed and arranged to angle upwardly and rearwardly from where it is secured by said fastener to said wall means when not pressed down towards said floor by having weighing down thereon either a said cylindrical article contained in said cradle at said first site or a said alternate article contained in said cradle at least partly in said first site;

said flat spring having a stop means formed thereon distally of said one end and being constructed and arranged to face rearwardly at such an elevated level when said barrier is raised, as to be positioned to abut the forward end of a said cylindrical article when contained in said second site upon any attempt being made to urge such cylindrical article substantially forwards from said second site when no said article is contained in said first site.

15. The vending machine of claim 14, wherein:

said flat spring, except when resiliently pressed down by a said article weighing thereon, curls upwards from where it is secured by said fastener to said wall means; and said stop means is provided by a rear end of said flat spring.

16. The vending machine of claim 15, wherein:

said wall means defining said floor includes means defining a shallow pocket constructed and arranged to receive said flat spring when said flat spring is pressed down by a said article weighing thereon.

17. The vending machine of claim 13, wherein:

said anti-theft device is provided by an elongated leaf spring secured near a forward end thereof to the cradle by a securement means and being constructed and arranged to angle upwardly and rearwardly from such securement, when not resiliently pressed down by a said article weighing thereon.

* * * * *